US006126156A

United States Patent [19]

Brodeur

[11] Patent Number: 6,126,156

[45] Date of Patent: Oct. 3, 2000

[54] JOIST HANGER MOUNTING TOOL

[76] Inventor: Philip Brodeur, 7320 Bramblewood Rd., Fort Worth, Tex. 76133

[21] Appl. No.: 09/124,399

[22] Filed: Jul. 29, 1998

[51] Int. Cl.[7] ..... B25B 1/20

[52] U.S. Cl. ..... 269/41; 269/3; 269/6; 269/904; 29/270; 29/278

[58] Field of Search ..... 269/41, 3, 6, 239, 269/259 R, 904, 903, 237, 238, 155; 29/281.1, 281.5, 281.6, 270, 278

[56] References Cited

U.S. PATENT DOCUMENTS

| | | | |
|---|---|---|---|
| 3,357,464 | 12/1967 | Vroman | 269/904 |
| 3,601,386 | 8/1971 | Estep | 269/904 |
| 3,663,004 | 5/1972 | Hupert | 269/904 |
| 4,181,295 | 1/1980 | Duffy | 269/904 |
| 4,290,591 | 9/1981 | Smith | 269/904 |
| 4,485,543 | 12/1984 | Flores, Jr. et al. | 269/904 |
| 4,888,879 | 12/1989 | Dixon | 269/904 |
| 4,947,616 | 8/1990 | Sorton | 52/749 |
| 4,958,814 | 9/1990 | Johnson | 269/904 |
| 5,054,755 | 10/1991 | Hawkes | 269/239 |
| 5,312,095 | 5/1994 | Rennie | 269/41 |
| 5,383,320 | 1/1995 | Sorton | 52/749 |
| 5,758,430 | 6/1998 | Holloway | 269/904 |

*Primary Examiner*—David A. Scherbel
*Assistant Examiner*—Lee Wilson
*Attorney, Agent, or Firm*—Charles D. Gunter, Jr.

[57] ABSTRACT

The present invention is a tool that quickly and accurately places joist hangers on headers to prepare the headers for the installation of joists. The tool has a lower flange which includes a transverse slot. An upper flange on the tool has two recesses spaced apart along a forward face of the upper flange. The recesses and the transverse slot cooperate to engage and constrain the joist hanger during installation. The tool also includes a handle member with a grip portion located remotely from the main body of the tool. The handle member allows an installer to position and install the joist hanger without exposing his hand to the area of installation.

11 Claims, 2 Drawing Sheets

JOIST HANGER MOUNTING TOOL

BACKGROUND

1. Field of the Invention

The present invention relates generally to carpentry tools and, specifically, to a tool that is used to quickly and properly secure joist hangers to headers so that joists can be accurately and securely attached to the supporting structure of a building.

2. Description of the Prior Art

Joist hangers include integral prongs to enable initial attachment to a beam or header. Traditionally, the joist hangers were located and then temporarily held by the prongs. Final attachment was accomplished using nails to secure the joist hanger. Today, carpenters and craftsmen can quickly install joist hangers using powered nail guns. Several joist hanging tools currently exist. The current tools, however, require the use of two hands to either adjust the tool or to install the joist hanger. With these tools, the joist hanger is not nailed to the header until either the tool is securely fastened to the header or the prongs have been used to fasten the hanger to the header.

U.S. Pat. No. 5,054,755 shows a joist hanger tool for securing and installing joist hangers on headers. The tool uses a hinge and spring mechanism to temporarily secure the joist hanger to the header. This tool does not remove the installer's hand from the vicinity of the joist hanger.

U.S. Pat. No. 5,312,095 is another joist hanger installation tool. This patent shows a tool with an adjustable support hook that allows the tool to be adapted to different sized headers. The adjustable support hook is secured with a set screw and is used to hang the tool and joist hanger from the header. The '095 device would not remove the installer's hands from the immediate vicinity of the nail gun.

U.S. Pat. No. 5,383,320 also does not remove the installer's hand from the immediate vicinity of the nail gun. This patent shows an adjustable joist hanger installation tool which locates the hanger using a support that is rested on the upper face of a header. The joist hangers are secured to the tool using magnets.

U.S. Pat. No. 4,947,616 also positions a joist hanger using a support member aligned with the upper face of the header. The '616 device uses magnets to constrain the joist hanger during installation. The device is adjustable and does not remove the installer's hands from the vicinity of the joist hanger during the preliminary installation process.

It is an object of the present invention to provide a joist hanger device which eliminates the need to preliminarily attach the tool or the joist hanger to the building header.

Another object of the invention is to provide a joist hanger device which is especially adapted to enable installation of joist hangers using powered nail guns.

Another object of the invention is to promote safety of a user during joist hanger installation procedures by keeping the user's hands away from the joist hanger as the hanger is nailed to the header.

Another object of the invention is to provide a joist hanger device which is simple in design and economical to manufacture, which requires only one hand for final installation, and which enables accurate installation of the joist hanger to the header without attaching the tool to the header.

SUMMARY

The joist hanger installation tool of the invention includes a body with a handle member that is attached to the body.

The grip portion of the handle member is spaced away from the main body of the tool. The body of the tool includes lower and upper engagement means for engaging the joist hanger and providing the necessary alignment to mount the hanger.

The preferred embodiment of the tool includes a body and a handle member. The handle member is attached to the body and extends outward from the body. At the end of the handle member distal to the body, a grip portion is included for holding the tool. The body of the tool includes a transverse slot for lower engagement of the joist hanger. The transverse slot is located between a lower flange and another portion of the body. The body also includes a pair of spaced recesses formed in an upper flange for upper engagement of the joist hanger. The recesses serve to bias the upwardly-extending legs of the joist hanger to parallel vertical positions once the joist hanger is engaged by the recesses.

The present invention also includes a method for installing a joist hanger. Using the tool of the invention, a joist hanger is first "loaded" into the tool by inserting the lower transverse portion of the joist hanger into the transverse slot. The upwardly-extending legs of the joist hanger are then aligned and inserted into the recesses on the upper flange of the tool. Using the tool, the angled flanges of the upwardly-extending legs are positioned against the mounting surface of the header. The joist hanger is aligned vertically along the header by positioning the upper face of the lower flange against the lower surface of the header. The joist hanger is aligned horizontally along the header according to the preference of the installer. The joist hanger is then attached to the header using nails dispensed from a nail gun.

Additional objects, features, and advantages will be apparent in the written description which follows.

DETAILED DESCRIPTION OF THE INVENTION

Figures 1, 2:
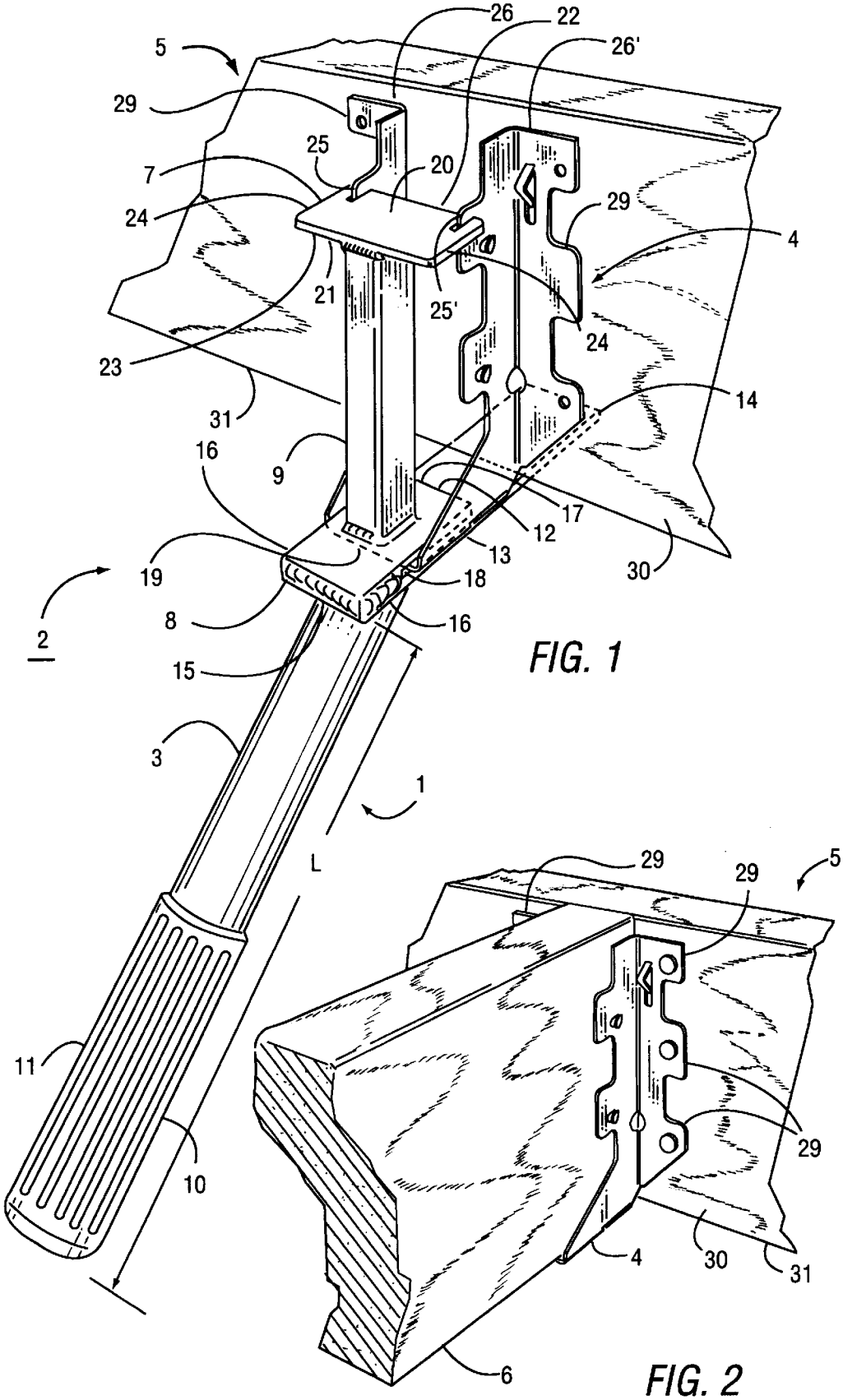
FIG. 1 is a perspective view of the joist hanger installation tool of the invention which is used for mounting a joist hanger on a header, the header being shown partly broken away.
FIG. 2 is a perspective view of an installed joist hanger following the use of the joist hanger installation tool of FIG. 1.

FIG. 1 shows a joist hanger installation tool 1 which consists of a main body 2 and a handle member 3. The joist hanger installation tool 1 is used to install a joist hanger 4 to a header 5. The joist hanger 4, when installed to the header 5, facilitates the installation of a joist 6 to the header 5 (see FIG. 2).

The main body 2 includes an upper flange 7 and a lower flange 8 arranged in spaced parallel planes. The two flanges are connected by a generally perpendicular connecting member 9, which extends between the upper flange 7 and the lower flange 8. The connecting member 9 is generally square in cross section and is affixed generally centered in a planar surface area of the upper and lower flanges 7, 8. Attached to the lower flange 8 is the handle member 3, which extends from the main body 2 at an obtuse angle β which, in the embodiment shown, is approximately 145 degrees (see FIG. 4). The handle member 3 includes a grip portion 10 that is held during installation. In the preferred embodiment, the grip portion 10 includes a synthetic or rubber sleeve 11 to increase comfort and grip performance. The length L of the handle member 3 is approximately 2.5 times the length of the connecting member 9 of the main body 2 with the grip portion 10 being located in the distal portion of the length L, whereby the user's hands are spaced apart from the main body 2.

The lower flange 8 has an upper face 12, lower face 13, front face 14, rear face 15, and two side faces 16. The upper face 12 of the lower flange 8 includes a stepped potion 17. The stepped portion 17 is located toward the rear face 15 of the lower flange 8. A transverse slot 18 is formed between the lower flange 8 and a portion of the body and extends rearwardly into the stepped portion 17. The transverse slot 18 is adapted to slidingly receive the lower transverse portion 19 of the joist hanger 4.

The upper flange 7 has an upper face 20, lower face 21, front face 22, rear face 23, and two side faces 24. The front face 22 of the upper flange 7 includes two recesses 25, 25'. The recesses 25, 25' are adapted to receive and constrain the upwardly-extending legs 26, 26' of the joist hanger 4. As will be explained, the recesses 25, 25' forming part of the upper engagement means of the device serve to bias the upwardly-extending legs 26, 26' of the joist hanger 4 toward parallel vertical positions, as shown in FIG. 1.

Figure 3:
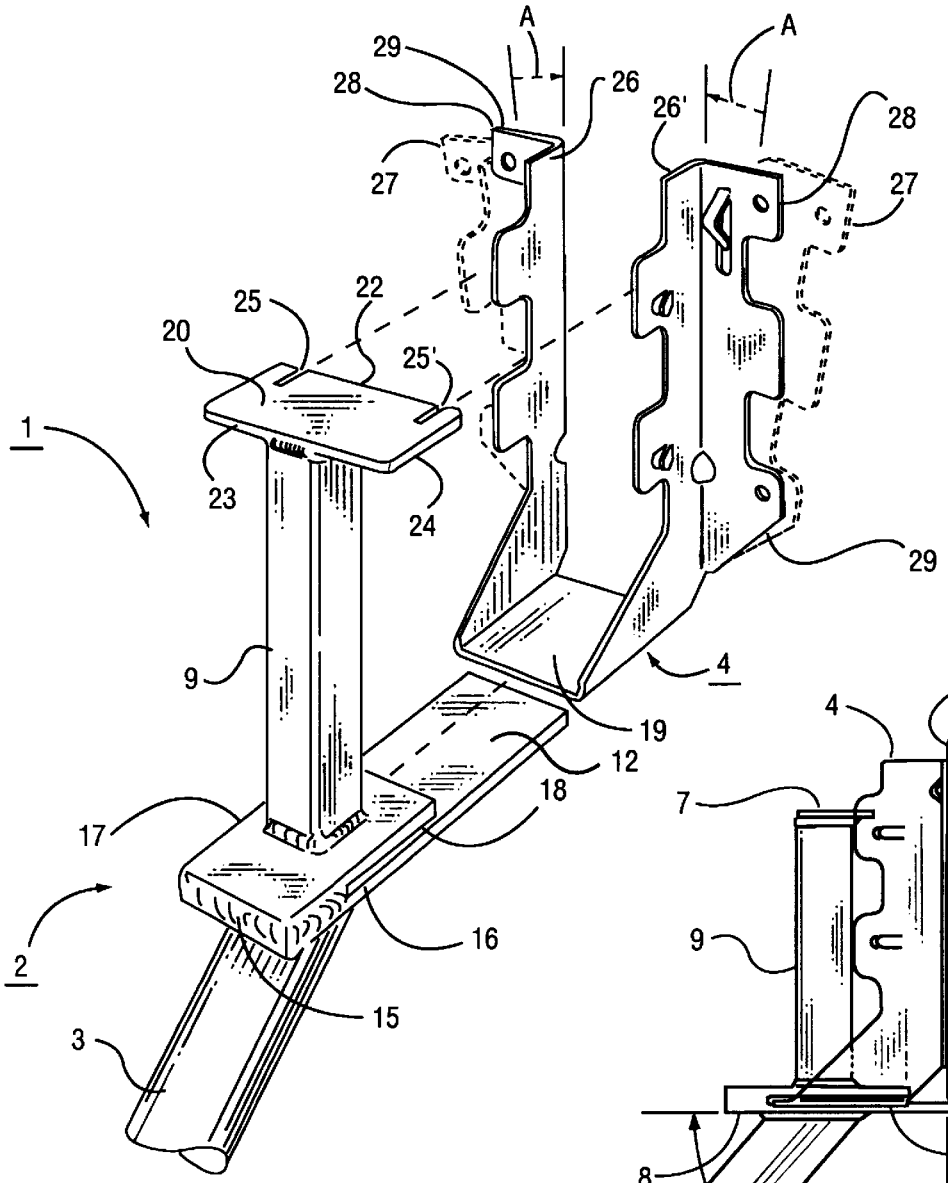
FIG. 3 is a perspective view showing how a joist hanger is loaded into the joist hanger installation tool of the invention, the tool handle being partly broken away.
Figure 4:
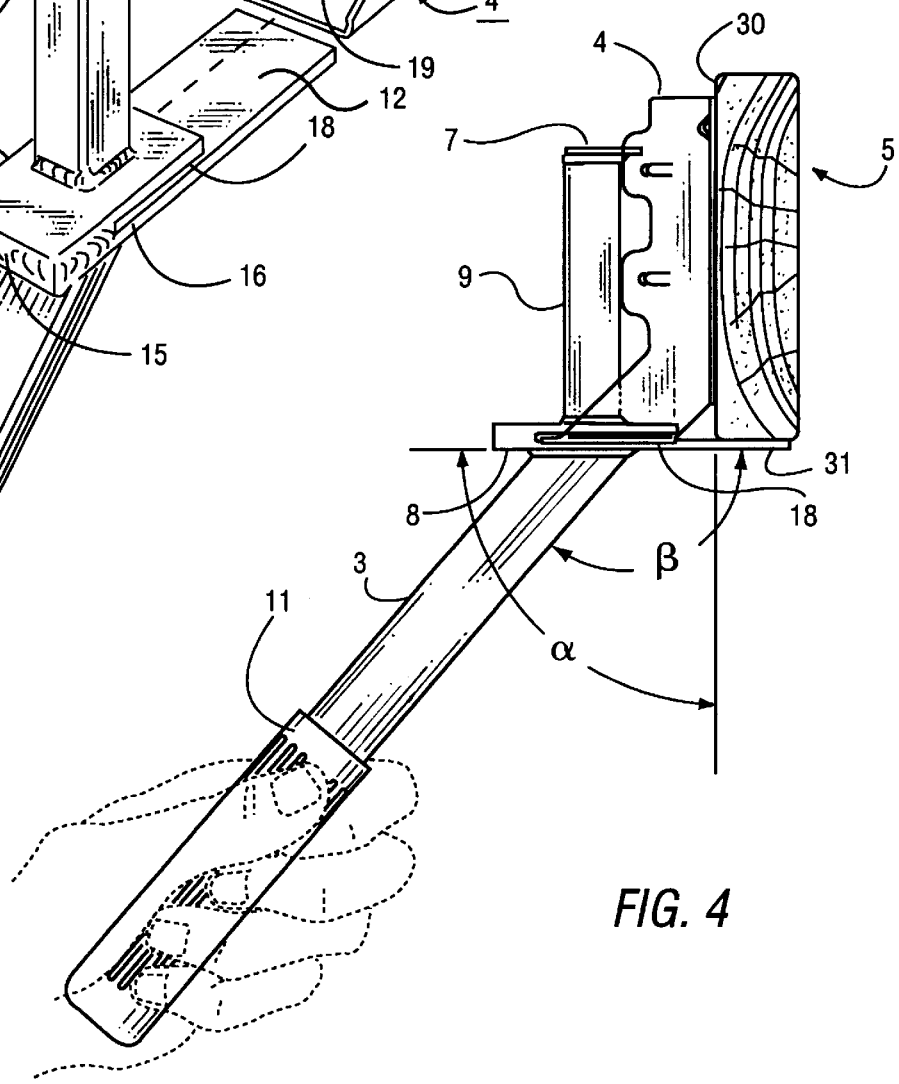
FIG. 4 is a side view showing the tool of the invention being used for alignment and installation of a joist hangar.

The proper use and operation of the joist hanger installation tool 1 is best shown in FIG. 3 and FIG. 4. The joist hanger 4 is loaded into the joist hanger installation tool 1 by inserting the lower transverse portion 19 into the transverse slot 18 where it is held in frictional engagement. The upwardly-extending legs 26, 26' are then moved from starting position 27 (shown in phantom lines) to installation position 28.

The biasing movement of the upwardly-extending legs 26, 26' is shown by arrow A. In the case shown, the legs 26, 26' are biased inwardly. However, depending upon the starting position, the legs might be biased outwardly, as well. After the upwardly-extending legs 26, 26' are in the installation position 28, the joist hanger 4 is pushed further into the tool 1 so that the upwardly-extending legs 26, 26' are received and constrained by the recesses 25, 25'.

With the joist hanger 4 loaded into the joist hanger installation tool 1, the angled flanges 29 of the upwardly-extending legs 26, 26' are positioned against the mounting surface 30 of the header 5 (see FIG. 4). The joist hanger 4 is vertically aligned by positioning the upper face 12 of the lower flange 8 against the lower surface 31 of the header 5. The preferred embodiment is such that the angle $\alpha$ formed following vertical alignment is a right angle. The joist hanger 4 is horizontally aligned according to the preference of the installer. While the joist hanger 4 and joist hanger installation tool 1 are held in place, the joist hanger 4 is attached to the header 5 using nails. Typically, this would be accomplished through the use of a conventional nail gun (not shown).

An invention has been provided with several advantages. A primary advantage of the current invention is that the hand of the installer is removed from the area of installation when the joist hanger is attached to the header. Even though the installer's hand is remotely located with respect to the installation area, the device securely positions and holds the joist hanger while it is attached to the header. The current invention is simple in design and economical to manufacture. The tool can conveniently be made from metal, plastic, or any suitable rigid material.

While the invention has been shown in only one of its forms, it is not thus limited but is susceptible to various changes and modifications without departing from the spirit thereof.

What is claimed is:

1. A tool for mounting a joist hanger having a lower transverse portion and two upwardly-extending legs to a header, the tool comprising:

a body;

a handle member attached to the body, the handle member extending outward from the body, the handle member including a grip portion, the grip portion being spaced apart from the body;

wherein the body includes upper and lower engagement means provided on the body for slidingly engaging the joist hanger for providing vertical and longitudinal alignment of the joist hanger on the header, the upper engagement means serving to bias the upwardly-extending legs of the joist hanger toward parallel vertical positions when the joist hanger is engaged on the body of the tool; and wherein the body includes upper and lower parallel flanges arranged in spaced fashion on the tool body, and wherein the upper engagement means is a pair of spaced recesses formed in the upper flange and the lower engagement means is a transverse slot formed between the lower flange and a portion of the body.

2. A tool according to claim 1, wherein the lower flange is adapted to vertically constrain the lower transverse portion of the joist hanger, the lower flange having an upper face, a lower face, a front face, a rear face, and two side faces, the upper face configured to mate with a lower surface of the header during installation of the joist hanger; and wherein the transverse slot is adapted to slidingly receive the lower transverse portion of the joist hanger.

3. A tool according to claim 2, wherein the upper flange has an upper face, a lower face, a front face, a rear face, and two side faces;

the spaced recesses include a first recess and a second recess located on the front face of the upper flange, the first recess separated from the second recess along the front face of the upper flange, the first recess and the second recess adapted to receive and horizontally constrain the upwardly-extending legs of the joist hanger; and a connecting member having a first end and a second end, the first end attached to the upper flange, the second end attached to the lower flange.

4. A tool according to claim 3 wherein the upper flange and the lower flange are rigidly attached and static with respect to the connecting member.

5. A tool according to claim 2 wherein the body and the handle member are formed of metal.

6. A tool for mounting a joist hanger to a header comprising:

a handle member having a first end and a second end, the first end having a grip portion;

a body including a lower flange rigidly connected to the second end of the handle member, the lower flange having an upper face, a lower face, a front face, a rear face, and two side faces;

a transverse slot formed between the lower flange and a portion of the body, the transverse slot extending rearward in the direction of the handle member;

a connecting member having a first end and a second end, the first end rigidly attached to the lower flange;

an upper flange rigidly attached to the second end of the connecting member, the upper flange having an upper face, a lower face, a front face, a rear face, and two side faces; and a first recess and a second recess located on the front face of the upper flange, the first recess separated from the second recess along the front face of the upper flange.

7. The tool according to claim 6 wherein the handle members the lower flange, the upper flange, and the connecting member are formed of metal.

8. A tool according to claim 6 wherein the grip portion includes a synthetic or rubber sleeve so as to increase comfort and grip performance.

9. A method for installing a joist hanger having a lower transverse portion and two upwardly-extending legs, each upwardly extending leg having an angled flange attached thereto, to a header having an upper surface, a lower surface, and a mounting surface, comprising the steps of:

providing a handle member having a first end and a second end, the first end having a grip portion;

providing a body including a lower flange rigidly connected to the second end of the handle member, the lower flange having an upper face, a lower face, a front face, a rear face, and two side faces;

providing a transverse slot located between the lower flange and a portion of the body;

providing a connecting member having a first end and a second end, the first end rigidly attached to the lower flange;

providing an upper flange rigidly attached to the second end of the connecting member, the upper flange having an upper face, a lower face, a front face, a rear face, and two side faces;

providing a first recess and a second recess located on the front face of the upper flange, the first recess separated from the second recess along the front face of the upper flange;

inserting the lower transverse portion of the joist hanger into the transverse slot;

aligning and constraining the upwardly-extending legs of the joist hanger with the first and second recesses;

positioning the angled flanges of the upwardly-extending legs against the mounting surface of the header;

aligning the joist hanger vertically on the header by positioning the upper face of the lower flange against the lower surface of the header;

aligning the joist hanger horizontally according to the preference of the installer; and attaching the joist hanger to the header.

10. The method according to claim 9 whereby the joist hanger is attached to the header using nails.

11. The method according to claim 10 whereby the nails are installed with an electric, hydraulic, or pneumatic nail gun.

* * * * *